US006406799B1

(12) United States Patent
Aihara et al.

(10) Patent No.: US 6,406,799 B1
(45) Date of Patent: Jun. 18, 2002

(54) METHOD OF PRODUCING ANTI-CORROSION MEMBER AND ANTI-CORROSION MEMBER

(75) Inventors: Yasufumi Aihara, Sunneyvale, CA (US); Keiichiro Watanabe, Kasugai; Kiyoshi Araki, Nagoya, both of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/494,987

(22) Filed: Jan. 31, 2000

(30) Foreign Application Priority Data

Feb. 1, 1999 (JP) ..... 11-023926
May 21, 1999 (JP) ..... 11-141240
Nov. 12, 1999 (JP) ..... 11-322687

(51) Int. Cl.[7] ..... B21D 39/00
(52) U.S. Cl. ..... 428/624; 428/689; 428/696
(58) Field of Search ..... 428/411.1, 469, 428/472.2, 624, 689, 696

(56) References Cited

U.S. PATENT DOCUMENTS 4,643,241 A 2/1987 Yonekura et al.
5,069,938 A * 12/1991 Lorimer et al. ..... 427/255.1
5,811,195 A 9/1998 Bereaw et al.

FOREIGN PATENT DOCUMENTS

DE 11 98 074 B 8/1965
EP 0 460 700 A1 12/1991
EP 0 770 702 A1 5/1997
FR 0 730 746 8/1996
JP 2-263972 A 10/1990

OTHER PUBLICATIONS

Patent Abstracts of Japan, vol. 016, No. 273 (C–0953), Jun. 18, 1992 & JP 4–066657 A (Mitsubishi Alum Co Ltd; Others: 01), Mar. 3, 1992 *abstract*.
Patent Abstracts of Japan, vol. 017, No. 259 (C–1061), May 21, 1993 & JP 5–001365 (Kokusai Electric Co Ltd), Jan. 8, 1993 *abstract*.

* cited by examiner

*Primary Examiner*—Deborah Jones
*Assistant Examiner*—Andrew T Piziali
(74) *Attorney, Agent, or Firm*—Burr & Brown

(57) ABSTRACT

A base member made of a metal in which aluminum is included, ceramics in which an aluminum element is included, or a composition member constructed by a metal in which aluminum and ceramics are included, is provided in a container in which a solid fluorine compound such as $NaHF_2$ is filled. Then, the container is heated at a temperature higher than a decomposition temperature of the solid fluorine compound. After that, the base member is subjected to a heat treatment with the decomposed gas of the solid fluorine compound to form a fluoride layer on a surface of the base member. In this manner, it is possible to obtain an anti-corrosion member which shows a high corrosion property with respect to the corrosion gas of halogen series and its plasma, particularly with respect to chlorine gas and its plasma.

10 Claims, 10 Drawing Sheets

METHOD OF PRODUCING ANTI-CORROSION MEMBER AND ANTI-CORROSION MEMBER

BACKGROUND OF THE INVENTION

1. Field of the Invention

The present invention relates to a method of producing an anti-corrosion member and an anti-corrosion member.

2. Description of Related Art

In accordance with an enlargement of memory storage in super LSI, a micro-fabrication technique is improved more and more, and a process which requires a chemical reaction is improved accordingly. Particularly, in a semiconductor manufacturing apparatus which requires a super clean condition, use is made of a corrosion gas of halogen series such as chlorine gas, fluorine gas and so on as a deposition gas, an etching gas and a cleaning gas.

For example, in the semiconductor manufacturing apparatus such as a thermal CVD apparatus, use is made of a semiconductor cleaning gas made of a corrosion gas of halogen series such as $ClF_3$, $NF_3$, $CF_4$, HF and HCl after a deposition operation. Moreover, even in the deposition operation, use is made of a corrosion gas of halogen series such as $WF_6$, $SiH_2Cl$ as a film forming gas.

Members constructing the semiconductor manufacturing apparatus are formed, for example, by anodized aluminum, aluminum nitride and so on.

Recently, it is found that silicon carbide (SiC) shows a relatively high anti-corrosion property with respect to the corrosion gas of halogen series mentioned above, and thus SiC is gradually used for the construction members of the semiconductor manufacturing apparatus.

Further, Japanese Patent Laid-Open Publication No.2-263972 (JP-A-2-263972) discloses a technique such that a fluorine passivated film made of a metal fluoride as a main ingredient in a stoichiometric state is formed on a surface of a metal member and an anti-corrosion property of the metal member with respect to the corrosion gas of halogen series is improved by the thus formed fluorine passivated film.

However, in the anodized aluminum, a surface oxidization film is shrunk at a temperature about 300° C. and thus cracks are generated. Therefore, if it is exposed in the corrosion gas of halogen series at a high temperature, a base aluminum is corroded via crack portions, and the surface oxidization film corresponding to the thus corroded portion is peeled off from the member to generate particles.

Moreover, in aluminum nitride, there is a tendency such that use is made of a highly corrosion gas such as $NF_3$ for the purpose of increasing an etching speed. Therefore, there is a drawback such that, if it is exposed in this highly corrosive gas at a high temperature, as in the case of anodized aluminum, a surface thereof is corroded and particles are generated. If the thus generated particles are sedimented on a base member provided in a semiconductor manufacturing apparatus, there occurs a phenomenon such as an insulation defect and a conduction defect, and these defects become a cause of a semiconductor defect.

Further, as mentioned above, silicon carbide shows a relatively high anti-corrosion property with respect to the corrosion gas of halogen series, but there is a drawback such that it is difficult to make a large construction member by using silicon carbide since it is hard to be sintered.

Here, there is a trial such that a porous member made of silicon carbide is formed, and then aluminum and so on are immersed in pores of the thus formed porous member to manufacture a large construction member. However, since an anti-corrosion property of the thus immersed aluminum is low, the thus manufactured large construction member has also a low anti-corrosion property with respect to the corrosion gas of halogen series, so that there is a drawback such that applicable fields of the thus manufactured large construction member are limited.

Further, in the method disclosed in JP-A-2-263972, there is a drawback such that an anti-corrosion property with respect to a plasma gas of halogen series especially with respect to a chlorine plasma gas is extremely low.

SUMMARY OF THE INVENTION

An object of the invention is to provide a new method of producing an anti-corrosion member and an anti-corrosion member which shows a high anti-corrosion property with respect to a corrosion gas of halogen series.

According to the invention, a method of producing all anti-corrosion member having a base member made of a metal in which aluminum is included, ceramics in which an aluminum element is included, or a composition member constructed by a metal in which aluminum and ceramics are included, and an anti-corrosion film formed on the base member, comprises the steps of: setting the base member in a container in which a solid fluorine compound is filled; heating the container at a temperature higher than a decomposition temperature of the fluorine compound to generate a decomposed gas of the fluorine compound and to subject the base member to a heat treatment with the decomposed gas of the fluorine compound; and forming an anti-corrosion film made of a fluoride on a surface of the base member.

Moreover, according to the invention, an anti-corrosion member comprises a base member made of a metal in which aluminum is included, ceramics in which an aluminum element is included or a composite member constructed by a metal in which aluminum and ceramics are included, and an anti-corrosion film made of a fluoride generated on a surface of the base member by setting the base member in a container in which a solid fluorine compound is filled and by heating the container at a temperature higher than a decomposition temperature of the solid fluorine compound.

The inventors attempted to find a new method of producing an anti-corrosion member and a new anti-corrosion member so as to improve an anti-corrosion property of a member which constructs a semiconductor manufacturing apparatus with respect to a corrosion gas of halogen series especially a plasma gas of halogen series.

As a result, it was found that a fluoride layer preferably having a main crystal phase of $AlF_3$ was formed on a surface of a base member by setting the base member made of aluminum in a sealed container in which a solid fluorine compound such as $NaHF_2$ is included and by heating the sealed container at a temperature higher than a decomposition temperature of the fluorine compound to perform a heat treatment for a predetermined time interval. Then, it was found that the thus formed anti-corrosion member had a high anti-corrosion property with respect to the corrosion gas of halogen series, especially the plasma gas of halogen series such as a chlorine plasma gas.

The base member mentioned above is formed by aluminum metal, an aluminum alloy, ceramic material in which an aluminum element is included, and a composite member. Therefore, it is possible to easily perform casting and sintering operations, and thus a manufacturing of the large construction member becomes easy.

Therefore, the anti-corrosion member manufactured according to the method of the invention has an excellent anti-corrosion property with respect to the corrosive gas of halogen series, and it is possible to easily manufacture the large construction member by using this anti-corrosion member. In addition, it is not necessary to use complicated manufacturing equipment, and thus problems associated with high cost manufacturing operations are limited.

FIG. 1 is a schematic view showing an X-ray diffraction pattern of an anti-corrosion member according to the invention. Moreover, FIG. 2 is an SEM cross sectional photograph showing a surface of the anti-corrosion member mentioned above.

From the X-ray diffraction pattern shown in FIG. 1, it is possible to observe a peak from $AlF_3$ crystal phase other than a peak from aluminum which constructs the base member. That is to say, it is understood that a fluoride in which $AlF_3$ is included as a main crystal phase is formed on a surface of the member obtained according to the method of the invention.

Moreover, from the SEM cross sectional photograph shown in FIG. 2, it is understood that a film having a layer a thickness of which is about 4 $\mu$m is formed.

In the producing method according to the invention, a mechanism of forming a fluoride phase on a surface of the base member is assumed as follows.

For example, when a container, in which $NaHF_2$ is filled as a solid fluorine compound, is heated and $NaHF_2$ is heated at a temperature higher than a predetermined temperature, $NaHF_2$ is decomposed by heat to generate hydrogen fluoride (HF) as shown in the following formula (1).

$$NaHF_2 \rightarrow NaF + HF \quad (1)$$

At the same time, an alumina ($Al_2O_3$) passivated film is formed on a surface made of, for example, an aluminum metal. Then, the thus formed alumina passivated film is reacted with the HF mentioned above according to the following formula (2), and alumina is transformed into aluminum trifluoride ($AlF_3$). In this manner, a fluoride layer is formed on a surface of the base member.

$$Al_2O_3 + 6HF \rightarrow 2AlF_3 + 3H_2O \quad (2)$$

It should be noted that the fluoride layer according to the invention is not necessarily existed as a complete continuous layer, but includes the case such that fluoride particles are aligned thickly.

In a method of producing an anti-corrosion member according to the invention, it is necessary to subject a base member made of aluminum metal and so on to a heat treatment with a decomposed gas of a solid fluorine compound.

This heat treatment can be performed under an atmosphere by using an open container, but it is preferred that this heat treatment is performed under a pressurized state by using a sealed container. In this manner, it is possible to produce an anti-corrosion member having an extremely high corrosion property with respect to a corrosion gas of halogen series, especially a plasma gas of halogen series such as a chlorine plasma gas.

In the case that the heat treatment is performed under a pressurized state, it is preferred to set a pressure larger than 1.5 atm (for the same reason as mentioned above), and it is further preferred to set a pressure larger than 5 atm. Moreover, in the case that the heat treatment is performed under a pressurized state, an upper limit of the pressure is preferred to be 20 atm and is further preferred to be 10 atm if taking into consideration of a withstanding pressure of the container.

A temperature of the heat treatment is not limited, the only limitation is that the temperature be higher than a decomposition temperature of a solid fluorine compound, thereby making it possible to generate a decomposed gas by decomposing the fluorine compound.

However, in order to obtain the anti-corrosion member having a high anti-corrosion property with respect to the plasma gas of halogen series by subjecting the base member to the heat treatment under a pressurized state mentioned above, it is preferred to perform the heat treatment at a temperature 0–200° C. higher than the decomposition temperature of the solid fluorine compound, and it is further preferred to perform the heat treatment at a temperature more than 10° C. higher but at maximum 150° C. higher.

Moreover, a time interval of the heat treatment is varied in accordance with a thickness of a fluoride layer to be formed, a pressure in the container and kinds of fluorine gases, but it is preferred to be 5–40 hours.

Further, the solid fluorine compound used in this invention is not limited. All that is required is that it has a specific decomposition temperature and generate a decomposed gas by heating it at a temperature higher than the decomposition temperature. However, it is preferred to use the solid fluorine compound having the decomposition temperature of 100–300° C. If the solid fluorine compound has a relatively low decomposition temperature mentioned above, it is possible to easily heat the container during the heat treatment. Moreover, it is possible to easily perform the heat treatment of the base member under a pressurized state. As the solid fluorine compound, use is made of $NaHF_2$, KHF2 and $NH_4HF_2$, decomposition temperatures of which are 140–160° C., 240° C. and 120–160° C., respectively. Moreover, it is particularly preferred to use a fluorine compound which includes no metal element, and also it is particularly preferred to use the fluorine compound which generates hydrogen fluoride by the decomposition. Among them, it is most preferred to use $NH_4HF_2$. A meaning of the solid fluorine compound includes a bulk type, a particle type and a powder type. Since the solid fluorine compound of the powder type has a large surface area, it is possible to make a temperature of the overall powders uniform in a relatively short time, and thus it is possible to easily generate the decomposed gas by the decomposition.

In the producing method according to the invention, as the base member which constructs the anti-corrosion member, use is made of the following materials.

(1) metal in which aluminum is included: use is made of pure aluminum metal or aluminum alloy. The aluminum alloy may include silicon, iron, titanium, copper, manganese, magnesium, chromium and zinc other than aluminum. Particularly, it is preferred to use Al—Si alloy, Al—Mg alloy, Al—Cu—Mg alloy and Al—Si—Mg alloy. Moreover, it is also particularly preferred to use the aluminum alloy which includes magnesium.

(2) ceramics in which an aluminum element is included: it is particularly preferred to use aluminum nitride and alumina.

(3) composition member constructed by metal in which aluminum and ceramics are included: use is preferably made of the above-mentioned metal in which aluminum is included. The above-mentioned ceramics are not limited, but it is particularly preferred to use ceramics in which an aluminum element is included.

If use is made of a metal in which aluminum is included or a composition member, it is possible to easily form the base member having a predetermined dimension and shape. Therefore, the producing method according to the invention can be applied to the base member having a large dimension or the base member having a specific shape, and thus it is possible to easily form the anti-corrosion member having a large dimension or the anti-corrosion member having a specific shape. As a result, the producing method according to the invention can be applied to wide applications such as a semiconductor manufacturing apparatus.

The anti-corrosion member according to the invention is remarkable since it has an extremely high corrosion property with respect to chlorine plasma gas in addition to fluorine plasma gas. A weight loss of the anti-corrosion member is preferred to be smaller than 15 $mg/cm^2$ and is further preferred to be smaller than 1 $mg/cm^2$ when it is exposed at 460° C. for 5 hours in chlorine plasma gas obtained by exciting at a high frequency of 13.56 MHz and 800 W.

Therefore, in the case that the anti-corrosion member having the properties mentioned above is used for the semiconductor manufacturing apparatus as one example, it is possible to use the anti-corrosion member for a sufficiently long time interval under a normal condition as compared with known materials.

Moreover, according to the invention, a method of producing an anti-corrosion member having a base member made of a metal in which aluminum is included and an anti-corrosion film formed on the base member, comprises the steps of: setting the base member in a container in which a solid fluorine compound is filled; heating the container at a temperature higher than a decomposition temperature of the fluorine compound to generate a decomposed gas of the fluorine compound and to subject the base member to a heat treatment with the decomposed gas of the fluorine compound, so that an intermediate film made of a fluoride is formed on a surface of the base member; subjecting the base member and the intermediate film to a heat treatment to react with each other; and forming an anti-corrosion film made of a fluoride.

The inventors found that a fluoride film, which did not obtain a sufficient anti-corrosion property with respect to the corrosion gas of halogen series and which was easily peeled off from a surface of the base member, was generated on a surface of the base member, when various conditions such as the kind of fluorine compound, temperature and pressure were varied during the fluoridizing of the base member made of the metal in which aluminum was included. Then, it was understood that if such a fluoride film was further subjected to a heat treatment at a high temperature, the fluoride was reacted with a surface of the base member, and thus the fluoride film having a high anti-corrosion property was generated. The intermediate film made of fluoride having no anti-corrosion property mentioned above has an appearance, for example, shown in FIG. 3. Moreover, the film obtained by subjecting the intermediate film to heat treatment has an appearance shown in FIG. 4.

The inventors investigated characteristics and anti-corrosion property of the thus finally obtained fluoride anti-corrosion film and found that it had remarkable features as follows.

That is to say, as shown in FIGS. 5, 6, 10 and 11 for example, the anti-corrosion film was formed by fluoride particles which cover a surface of the base member. The fluoride particles have a large particle size, and when a line is drawn on a surface of the anti-corrosion film, the number of boundary phases across the line is smaller than 100 and larger than 5 per the line having a length of 10 $\mu$m on an average. This definition corresponds to a particle size of 0.1 $\mu$M–2.0 $\mu$m.

The fluoride film, generated by contacting the fluoride gas to the metal in which aluminum is include or by contacting the decomposed gas of the solid fluorine compound mentioned above, is very fine since it is obtained by means of a vapor method, and particles of the fluoride film are not distinctly observed by a microscope having 5000 magnification. On the contrary, the thus obtained anti-corrosion film has the features such that a particle size is very large, particles are thickly contacted with each other and there is no boundary phase.

Moreover, the fluoride particles include at least one (preferably both) of aluminum fluoride phase and magnesium fluoride phase. An aluminum element and a magnesium element are transferred from a surface of the base member to the film.

A thickness of the anti-corrosion film is assumed to be 0.1–2.0 $\mu$m in a normal condition since it is not observed by an SEM microscope having 5000 magnification.

An atmosphere during the heat treatment of the base member and the intermediate film is not limited if only it affects the base member, but it is particularly preferred to use an atmosphere in which oxygen and inert gas are included. A temperature of the heat treatment is preferred to be higher than 200° C. from the view point of improving the reaction between the intermediate film and the base member, and it is further preferred to be higher than 300° C. Moreover, in order to prevent a deterioration of the base member, it is preferred to be lower than 650° C. and is further preferred to be lower than 600° C.

The solid fluorine compound which is accommodated in the container is preferred to be the fluorine compound including no metal element. Such a fluorine compound is not limited if only it can be decomposed, but it is particularly preferred to be $NH_4HF_2$.

The intermediate film is generated by the reaction between the base member and fluoride gas, and it is particularly preferred to be an aluminum fluoride ammonium film.

Moreover, the inventors found that it was generally possible to generate an anti-corrosion film made of a fluoride by heating the base member and aluminum fluoride ammonium to react with each other.

That is to say, as mentioned above, the aluminum fluoride ammonium film is firstly generated as the intermediate film by heating the solid fluorine compound and the base member in the container. Then, the base member and the aluminum fluoride ammonium film are subjected to the heat treatment mentioned above in the container to generate the anti-corrosion film.

Moreover, as another method, it is possible to perform the heat treatment under a condition such that powders of aluminum fluoride ammonium are contacted to a surface of the base member. The powders mentioned above can be generated by a chemical reaction for example between aluminum hydroxide and ammonium fluoride saturated solution.

In this case, the aluminum fluoride ammonium powders are further accommodated in the container, and the base member is embedded in the powders. Then, the heat treatment is performed under the condition mentioned above. In another case, a formed film is obtained by mixing the aluminum fluoride ammonium powders with suitable organic solvent, binder and so on, preparing a coating slurry, and coating the coating slurry on the base member. The thus obtained formed film is subjected to the heat treatment together with the base member.

Here, the aluminum fluoride ammonium may be made of $(NH_4)_3AlF_6$ crystal only. Moreover, aluminum element of $(NH_4)_3AlF_6$ crystal may be substituted by other metal elements if only $(NH_4)_3AlF_6$ crystal maintains its crystal structure. As the other metal elements, it is generally preferred to use metal elements which are included in an aluminum alloy. As such metal elements, it is preferred to use silicon, magnesium, manganese, copper, iron and so on. Particularly, in an application of semiconductor manufacturing it is preferred to use silicon or magnesium.

The anti-corrosion member according to the invention can be applied to suscepter which is heated by means of an infrared lamp, heater for heating a semiconductor, suscepter provided on a heating surface of an heater for heating a semiconductor, suscepter in which an electrode for a static chuck is embedded, suscepter in which an electrode for a static chuck and a resistance heater are embedded, and suscepter in which an electrode for a high frequency plasma generation and a resistance heater are embedded. Moreover, the anti-corrosion member according to the invention can be used as the base member of the semiconductor manufacturing apparatus such as dummy wafer, shadow ring, tube for generating a high frequency plasma, dome for generating a high frequency plasma, high frequency transmitting window, infrared transmitting window, lift pin for supporting a semiconductor wafer, shadow plate and so on.

DESCRIPTION OF THE PREFERRED EMBODIMENT

Experiment A

EXAMPLE 1

1 g of $NaHF_2$ powders (decomposition temperature: 140–160° C.) having an average particle size of 10 $\mu$m was accommodated in a Teflon container whose capacity was 80 cc. Then, a Teflon mesh was provided on the $NaHF_2$ powders, and then an aluminum plate (base member) having a diameter of 20 mm and a thickness of 2 mm was provided on the Teflon mesh. In this case, the aluminum plate was not directly contacted to the $NaHF_2$ powders by means of the Teflon mesh.

Then, the thus prepared Teflon container was accommodated in a stainless container, and the stainless container was sealed. After that, the sealed stainless container was set in an oven, and a heat treatment was performed.

The heat treatment was performed at 300° C. for 10 hours. After that, the sealed stainless container was cooled in a room to an extent such that an inner temperature of the sealed stainless container was lower than 30° C. In this case, a pressure in the Teflon container during the heat treatment was about 20 atm. After that, the aluminum plate was picked up, and a surface of the thus picked up aluminum plate was examined by means of an X-ray.

Figure 1:
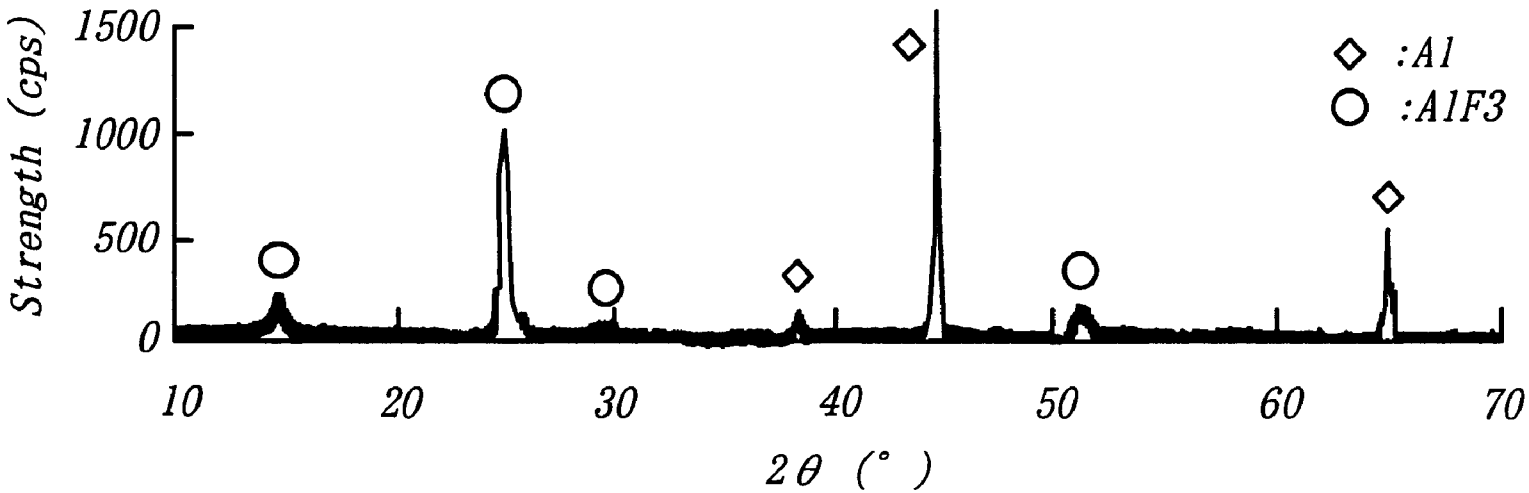
FIG. 1 is a schematic view showing an X-ray diffraction pattern on a surface of an anti-corrosion member obtained according to the producing method of the invention.

From the X-ray diffraction pattern shown in FIG. 1, the peak from the aluminum crystal and the peak from the $AlF_3$ crystal are observed. Therefore, the fluoride having $AlF_3$ as a main crystal phase is formed on a surface of the aluminum plate.

Figure 2:
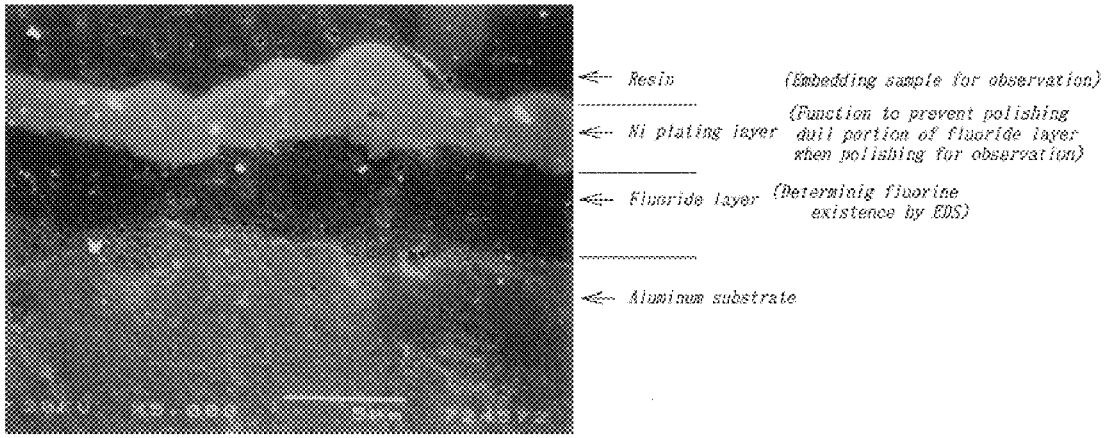
FIG. 2 is a photograph taken by an SEM illustrating a cross section on a surface region of the anti-corrosion member obtained according to the producing method of the invention.

Then, non-electrolytic Ni plating was performed on a surface of the thus obtained member, and then the member was cut out. Then, a cross section of the cut out portion of the member was observed by SEM, and it was found that a layer having a thickness of 2–5 $\mu$m was formed. Therefore, it was understood from FIGS. 1 and 2 that the fluoride layer having a thickness of 2–5 $\mu$m and having $AlF_3$ as a main crystal phase was formed on a surface of the aluminum plate.

Then, a corrosion test was performed with respect to the thus obtained anti-corrosion member. That is to say, use was made of a chlorine plasma gas obtained by exciting $Cl_2$ gas having a temperature of 300° C., a gas flow amount of 300 sccm and a pressure of 0.1 Torr by means of an induction coupling plasma having a frequency of 13.56 MHz and 1 kW. The anti-corrosion member was maintained in the thus excited gas for 5 hours. Then, an anti-corrosion property was estimated corresponding to a weight variation before and after the corrosion test mentioned above. The results are shown in Table 1.

EXAMPLE 2

In the example 1, use was made of $KHF_2$ powders (decomposition temperature: 240° C.) instead of $NaHF_2$ powders. The other processes were same as those of the example 1.

When a surface of the thus obtained anti-corrosion member was examined by an X-ray and an SEM (scanning electron microscope), it was found, as in experiment 1), that the fluoride layer having a thickness of 1–3 $\mu$m and having $AlF_3$ as a main crystal phase was formed. Moreover, a pressure in the Teflon container during the heat treatment was 20 atm. The results of the corrosion test are shown in Table 1.

EXAMPLE 3

The anti-corrosion member was obtained in the same manner as that of the example 1 except that a temperature of the heat treatment was 200° C.

When a surface of the thus obtained anti-corrosion member was examined by an X-ray diffraction, a peak from other than aluminum was not observed. Then, when the surface was further observed by an SEM/EDS, it was found that the fluoride was formed on a surface of the aluminum plate.

Moreover, when a cross section of the anti-corrosion member was examined by an SEM, it was found that a thickness of the fluoride was 0.6–0.8 $\mu$M. In addition, a pressure in the Teflon container during the heat treatment was 16 atm. The results of the corrosion test are shown in Table 1.

Comparative Example 1

The anti-corrosion member was obtained in the same manner as that of the example 1 except that a temperature of the heat treatment was 130° C.

As is the same as the example 1, when a surface of the thus obtained anti-corrosion member was observed by an X-ray diffraction and an SEM, a peak originated from the fluoride was not observed and no sedimentation was observed. The results of the corrosion test are shown in Table 1.

Comparative Example 2

The anti-corrosion member was obtained in the same manner as that of the example 2 except that a temperature of the heat treatment was 100° C.

As is the same as the example 1, when a surface of the thus obtained anti-corrosion member was observed by an X-ray diffraction and an SEM, a peak originated from the fluoride was not observed and no sedimentation was observed. The results of the corrosion test are shown in Table 1.

TABLE 1

| | Fluorine compound | Heat treatment temperature (° C.) | Pressure in container | Fluoride layer | Weight loss of member mg/cm$^2$ |
|---|---|---|---|---|---|
| Example 1 | $NaHF_2$ | 300 | 20 atm | exist | <0.1 |
| Example 2 | $KHF_2$ | 300 | 20 atm | exist | 0.3 |
| Example 3 | $NaHF_2$ | 200 | 16 atm | exist | 0.6 |
| Comparative Example 1 | $NaHF_2$ | 130 | atmosphere | not exist | 19.2 |
| Comparative Example 2 | $NaHF_2$ | 100 | atmosphere | not exist | 17.3 |

As is understood from Table 1, the anti-corrosion member, in which the fluoride layer formed by heating the container at a temperature higher than the decomposition temperature of $NaHF_2$ or $KHF_2$ as the solid fluorine compound and forming the fluoride layer on a surface of the base member by using the decomposed gas of the fluorine compound, according to the producing method of the invention, has a high corrosion property with respect to the corrosion gas of halogen series such as $Cl_2$ gas.

On the other hand, it is understood that the anti-corrosion member, in which the fluoride layer is not formed on a surface of the base member, shows a low anti-corrosion property with respect to the corrosion gas of halogen series such as $Cl_2$ gas since it has a large weight variation before and after the corrosion test.

Experiment B

EXAMPLE 4

1 g of $NaHF_2$ powders having an average particle size of 10 $\mu$m was accommodated on a bottom surface in an open cylindrical container made of a fluorine resin, an inner capacity of which was 70 cc. Then, a fluorine resin mesh was provided on the $NaHF_2$ powders, and then an aluminum alloy plate (base member: JIS6061) having a length of 10 mm, a breadth of 10 mm and a thickness of 2 mm was provided on the fluorine resin mesh. In this case, the aluminum alloy plate was not directly contacted to the $NaHF_2$ powders. Then, a plug was provided to an open portion of the fluorine resin container, and the fluorine resin container was set in an open stainless container. After that, the fluorine resin container was sealed by fastening the stainless container.

The thus sealed fluorine resin container was set in an oven, and a heat treatment was performed at 300° C. for 10 hours. After that, the sealed fluorine resin container was cooled in a room to an extent such that an inner temperature of the sealed fluorine resin container was lower than 30° C. In this case, a pressure in the fluorine resin container during the heat treatment was about 20 atm.

After that, the aluminum alloy plate was picked up, and a surface of the thus picked up aluminum alloy plate was examined by an X-ray diffraction. As a result, no peak from other than the base member was observed. Moreover, a surface and a cross section of the aluminum alloy plate were observed by an SEM, but no phase other than the base member was observed. However, when a surface composition of the aluminum alloy plate was examined by an EDS, an F element was strongly detected other than Al, Mg, Si which were contained in the base member. From this result, it was understood that the fluoride layer was formed on a surface of the base member.

Then, the following two kinds of corrosion tests were performed with respect to the anti-corrosion member. The results of two kinds of the corrosion tests are shown in Table 2.

In a corrosion test A, a mix gas of $NF_3$ and $N_2$ was excited. NF3 gas and $N_2$ gas had flow amounts of 75 sccm and 100 sccm respectively and had a pressure of 0.1 Torr. The mix gas was excited by using an induction coupling plasma having a frequency of 13.56 MHz and 800 W. Then, the anti-corrosion member was maintained in this fluorine plasma gas at 550° C. for 5 hours. Then, an anti-corrosion property was estimated corresponding to a weight increase before and after the corrosion test A. A sample was provided at a position apart by 300 mm from an excitation coil having a diameter of 120 mm. In this case, if the weight increase is larger, the anti-corrosion property becomes lower.

On the other hand, in a corrosion test B, a mix gas of $Cl_2$ and $N_2$ was excited. $Cl_2$ gas and $N_2$ gas had flow amounts of 300 sccm and 100 sccm respectively and had a pressure of 0.1 Torr. The mix gas was excited by using an induction coupling plasma having a frequency of 13.56 MHz and 800 W. Then, an anti-corrosion property was estimated corresponding to a weight loss before and after the corrosion test B. A sample was provided at a position apart by 300 mm from an excitation coil having a diameter of 120 mm. In this case, if the weight loss is larger, the anti-corrosion property becomes lower.

EXAMPLE 5

After the fluorizing treatment was performed as is the same as the example 4, the aluminum alloy plate was picked up from the container. Then, the thus picked up aluminum alloy plate was set in a heat treating furnace, and a heat treatment was performed in an atmosphere, at 550° C. for 2 hours.

As is the same as example 4, a surface of the aluminum alloy plate was observed by an X-ray diffraction and by an SEM, but no layer other than the base member was detected. However, when a chemical composition of a surface of the aluminum alloy plate was examined by an EDS, an F element was strongly detected other than Al, Mg, Si which were contained in the base member. From this result, it was understood that the fluoride layer was formed on a surface of the base member. The results of two kinds of the corrosion tests A and B are shown in Table 2.

EXAMPLE 6

The anti-corrosion member was obtained in the same manner as that of experiment 4 except that an amount of $NaHF_2$ powders was 0.5 g instead of 1 g and a temperature of the heat treatment was 200° C. instead of 300° C. In this case, a pressure in the container during the heat treatment was about 9 atm.

As is the same as example 4, a surface of the aluminum alloy was examined by an EDS. As a result, it was confirmed that the fluoride layer was formed on a surface of the base member. The results of two kinds of the corrosion tests A and B are shown in Table 2.

EXAMPLE 7

The anti-corrosion member was obtained in the same manner as that of experiment 4 except that an amount of $NaHF_2$ powders was 0.3 g instead of 1 g and a temperature of the heat treatment was 150° C. instead of 300° C. In this case, a pressure in the container during the heat treatment was about 5 atm.

As is the same as the example 4, a surface of the aluminum alloy was examined by an EDS. As a result, it was confirmed that the fluoride layer was formed on a surface of the base member. The results of two kinds of the corrosion tests A and B are shown in Table 2.

EXAMPLE 8

The anti-corrosion member was obtained in the same manner as that of experiment 4 except that $KHF_2$ powders were used instead of $NaHF_2$ powders. In this case, a pressure in the container during the heat treatment was about 20 atm.

After a chemical composition analysis of the aluminum alloy plate by means of an EDS, it was confirmed that the fluoride layer was formed on a surface of the base member made of the aluminum alloy plate. The results of two kinds of the corrosion tests A and B are shown in Table 2.

EXAMPLE 9

The anti-corrosion member was obtained in the same manner as that of experiment 4 except that an amount of $NaHF_2$ powders was 0.2g instead of 1 g, a material of the base member was JIS5052 aluminum alloy instead of JIS6061 aluminum alloy, and a temperature of the heat treatment was 200° C. instead of 300° C. In this case, a pressure in the container during the heat treatment was about 3 atm.

After a chemical composition analysis of the aluminum alloy plate by means of an EDS, it was confirmed that the fluoride layer was formed on a surface of the base member made of the aluminum alloy plate. The results of two kinds of the corrosion tests A and B are shown in Table 2.

EXAMPLE 10

The anti-corrosion member was obtained in the same manner as that of experiment 9 except that a material of the base member was JIS1050 alloy instead of JIS5052 aluminum alloy. In this case, a pressure in the container during the heat treatment was about 3 atm.

After a chemical composition analysis of the alloy plate by means of an EDS, it was confirmed that the fluoride layer was formed on a surface of the base member. The results of two kinds of the corrosion tests A and B are shown in Table 2.

Comparative Example 3

An aluminum alloy plate (JIS6061) having a length of 10 mm, a breadth of 10 mm and a thickness of 2 mm was provided in a chamber made of Ni. Then, the aluminum alloy plate was baked at 350° C. for 1 hour under a condition such that an $N_2$ gas was flowed under an atmosphere. Then, 100% $F_2$ gas was flowed under an atmosphere, and a heat treatment was performed at 350° C. for 10 hours with respect to the aluminum alloy plate. After that, an atmosphere in the chamber was exchanged by using a nitrogen gas, and a heat treatment was performed at 350° C. for 1 hour in this $N_2$ atmosphere. Then, the chamber was cooled to an extent such that a temperature in the chamber was lower than 30° C., and the aluminum alloy plate was picked up.

A surface of the thus picked up aluminum alloy plate was examined by an X-ray diffraction, but no peak other than the aluminum alloy as the base member was detected. Moreover, a surface and a cross section of the aluminum alloy plate were observed by an SEM, but no layer other than the aluminum alloy plate was detected. However, when a chemical composition of a surface of the aluminum alloy plate was examined by an EDS, an F element was strongly detected other than Al, Mg, Si which were contained in the aluminum alloy plate. From this result, it was understood that the fluoride layer was formed on a surface of the aluminum alloy plate. The results of two kinds of the corrosion tests A and B are shown in Table 2.

Comparative Example 4

The anti-corrosion member was obtained in the same manner as that of the comparative example 3 except that JIS1050 aluminum alloy plate was used instead of JIS6061 aluminum alloy plate.

From a chemical composition analysis by an EDS, it was understood that the fluoride layer was formed on a surface of the aluminum alloy plate. The results of two kinds of the corrosion tests A and B are shown in Table 2.

Comparative Example 5

The corrosion tests A and B were performed with respect to an aluminum alloy plate (JIS606 1) having a length of 10 mm, a breadth of 10 mm and a thickness of 2 mm. The results of the corrosion tests A and B are shown in Table 2.

Comparative Example 6

The corrosion tests A and B were performed with respect to an aluminum alloy plate (JIS1050) having a length of 10 mm, a breadth of 10 mm and a thickness of 2 mm. The results of the corrosion tests A and B are shown in Table 2.

TABLE 2

| | Fluoride layer | Kind of fluorine gas | Pressure in container (atm) | Anti-corrosion test A: weight increase due to fluorine plasma gas exposure mg/cm$^2$ | Anti-corrosion test B: weight loss due to chlorine plasma gas exposure mg/cm$^2$ |
|---|---|---|---|---|---|
| Example 4 | exist | $NaHF_2$ decomposed gas | 20 | <0.1 | 0.1 |
| Example 5 | exist | $NaHF_2$ decomposed gas | 20 | <0.1 | <0.1 |
| Example 6 | exist | $NaHF_2$ decomposed gas | 9 | <0.1 | 0.2 |
| Example 7 | exist | $NaHF_2$ decomposed gas | 5 | 0.1 | 0.3 |
| Example 8 | exist | $KHF_2$ decomposed gas | 20 | <0.1 | 0.01 |
| Example 9 | exist | $NaHF_2$ decomposed gas | 3 | <0.1 | 0.3 |
| Example 10 | exist | $NaHF_2$ decomposed gas | 3 | <0.1 | 12.9 |
| Comparative Example 3 | exist | $F_2$ gas | 1 | 0.3 | 33.1 |
| Comparative Example 4 | exist | $F_2$ gas | 1 | 2.6 | 82.5 |
| Comparative Example 5 | not exist | — | — | 0.7 | 35.6 |
| Comparative Example 6 | not exist | — | — | 3.2 | 85.9 |

As clearly understood from the examples and the comparative examples shown in Table 2, the anti-corrosion member obtained according to the invention, in which the fluoride layer was formed on a surface of the anti-corrosion layer by heating the base member by using the decomposed gas of $NaHF_2$ or $KHF_2$ as the solid fluorine compound, shows a high anti-corrosion property with respect to the fluorine plasma gas and the chlorine plasma gas. Particularly, there is a remarkable difference on the anti-corrosion property with respect to the chlorine plasma gas.

Moreover, even in the case that there is the fluoride layer on a surface of the base member, it is understood that the anti-corrosion property with respect to the fluorine plasma gas and the chlorine plasma gas is low if the anti-corrosion member is obtained by using the $F_2$ gas instead of the solid fluorine compound.

Experiment C

EXAMPLE 11

0.6 g of hydrogen fluoride ammonium ($NH_4F.HF$) powders having an average particle size of 10 $\mu$m was accommodated on a bottom surface in an open cylindrical container made of a fluorine resin, an inner capacity of which was 80 cc. Then, a fluorine resin mesh was provided on the powders, and then an aluminum alloy (JIS6061 alloy) plate having a length of 10 mm, a breadth of 10 mm and a thickness of 2 mm was provided on the fluorine resin mesh. In this case, the aluminum alloy plate was not directly contacted to the $N_4F.HF$ powders by using the mesh. Then, a plug was provided to an open portion of the cylindrical container, and the cylindrical container was set in an open stainless container. After that, the cylindrical container was sealed by embedding it.

The thus sealed fluorine resin container was set in an oven, and a heat treatment was performed at 250° C. for 16 hours. After that, the container was cooled in a room to an extent such that a temperature in the container was lower than 30° C. In this case, a pressure in the fluorine resin container was about 12 atm.

Figure 3:
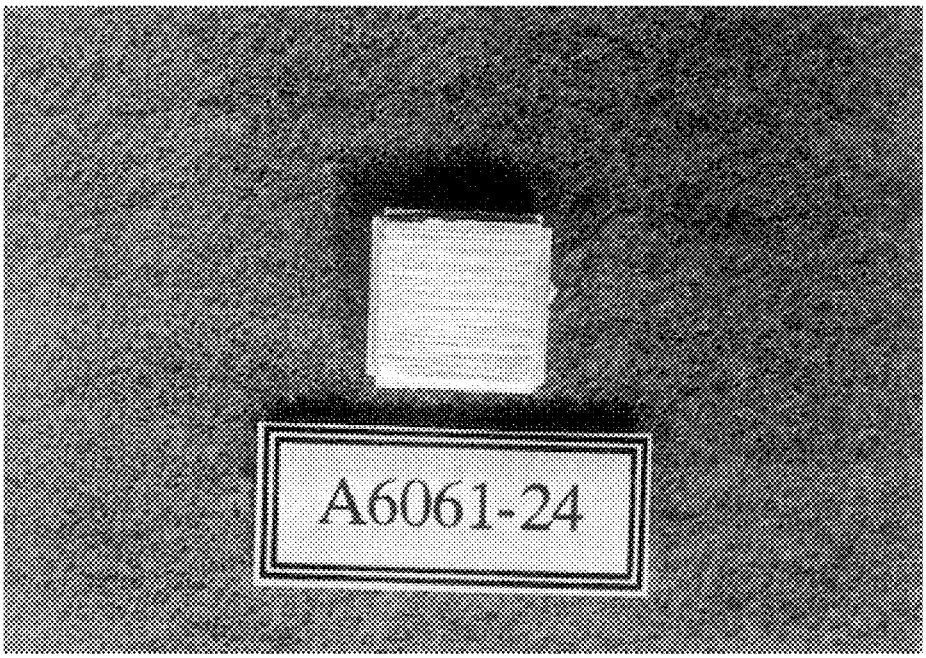
FIG. 3 is a photograph depicting an appearance of a surface of an aluminum alloy plate in an experiment 11 just after a fluoride treatment in a sealed container.

Then, the aluminum alloy plate was picked up from the container. In this case, a surface of the aluminum alloy plate was covered with a powdery precipitation member having a reddish color as shown in the photograph of FIG. 3. The precipitation member was identified, by an X-ray diffraction method, to be a compound having the same crystal structure as that of $(NH_4)_3AlF_6$.

Figure 4:
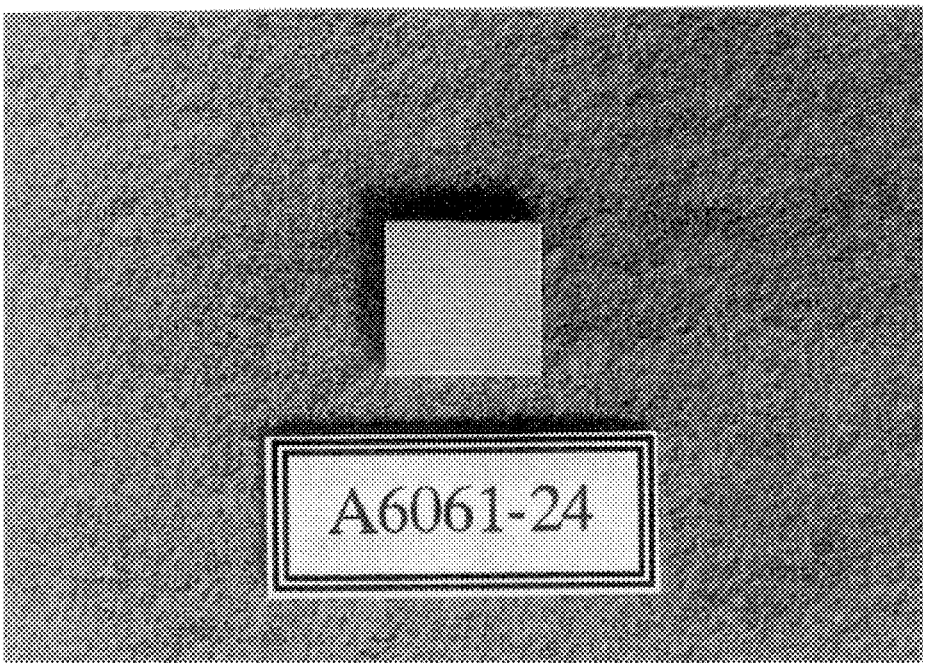
FIG. 4 is a photograph showing an appearance of the aluminum alloy plate in the experiment 11 shown in FIG. 3 just after it is further subjected to a heat treatment in an atmosphere.

Then, the aluminum alloy plate was subjected to a heat treatment in an atmosphere at 500° C. for 2 hours under a condition such that a surface of the aluminum alloy plate was maintained to be covered with the precipitation member. After the heat treatment, a reddish color was slightly faded, but an adhesion of aluminum fluoride ammonium remained on a surface of the aluminum alloy plate. This sample was subjected to an ultrasonic cleaning in acetone. As a result, aluminum fluoride ammonium was easily peeled off, and the aluminum alloy plate appeared from inside. A surface of the aluminum alloy plate showed a state such that a brilliance of the plate was lost as shown in the photograph of FIG. 4. Therefore, it was thought that some thin film was formed on a surface of the aluminum alloy plate.

Figure 5:
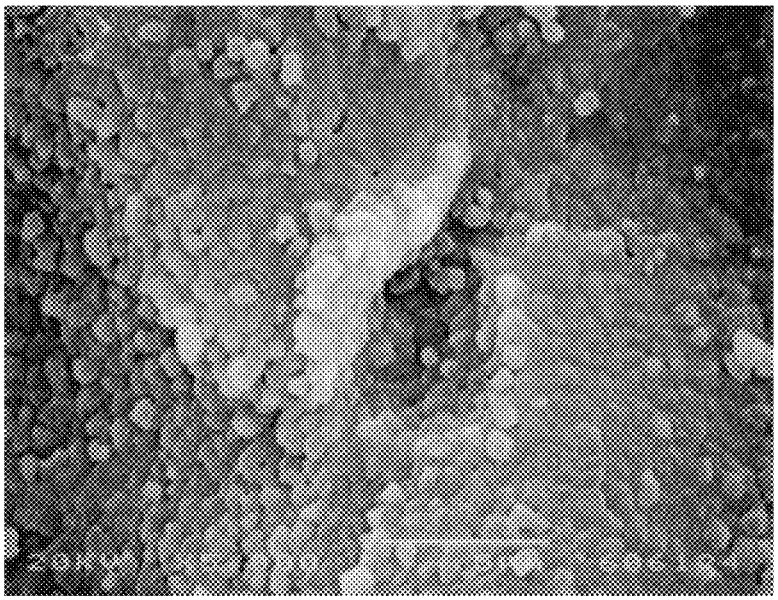
FIG. 5 is an SEM photograph of an anti-corrosion film formed on a surface of an anti-corrosion member in the experiment 11 (5000 magnification)
Figure 6:
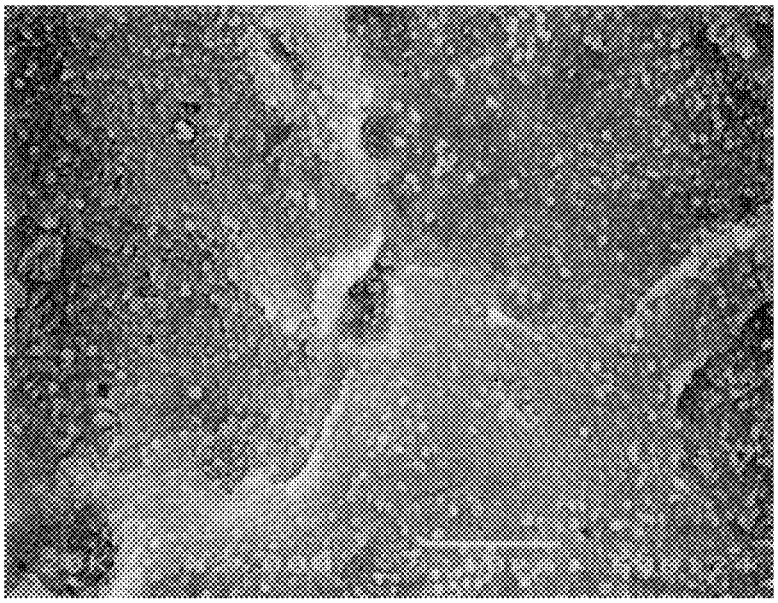
FIG. 6 is an SEM photograph of the anti-corrosion film formed on a surface of the anti-corrosion member in the experiment 11 (2000 magnification)

Photographs of a surface of the thus obtained anti-corrosion member taken by a scanning electron microscope (SEM) are shown in FIG. 5 (5000 magnification) and FIG. 6 (2000 magnification). From these photographs, it is understood that a thin film formed by crystal particles having a particle size of about 1 $\mu$m covers a surface of the base member. When a line was drawn on a surface of the anti-corrosion film, the number of boundary phases across the line was average 10 per the line having a length of 10 $\mu$m. In this measurement, an arbitrary surface region is picked up at the magnification (5000) which can detect particles and boundary phases respectively. Then, an arbitrary line is drawn on the thus picked up photograph, and the number of boundary phases across this line is calculated. In this case, a length of the line required for crossing 500 boundary phases is assumed to be L (unit is $\mu$m). On the basis of a calculation formula of $(500/L)\times 10$, the number of boundary phases per 10 $\mu$m is calculated. In this case, a length of the line required for crossing 500 boundary phases is assumed to be L (unit is $\mu$m). On the basis of a calculation formula of (500/L)×10, the number of boundary phases per 10 $\mu$m is calculated.

Figure 7:
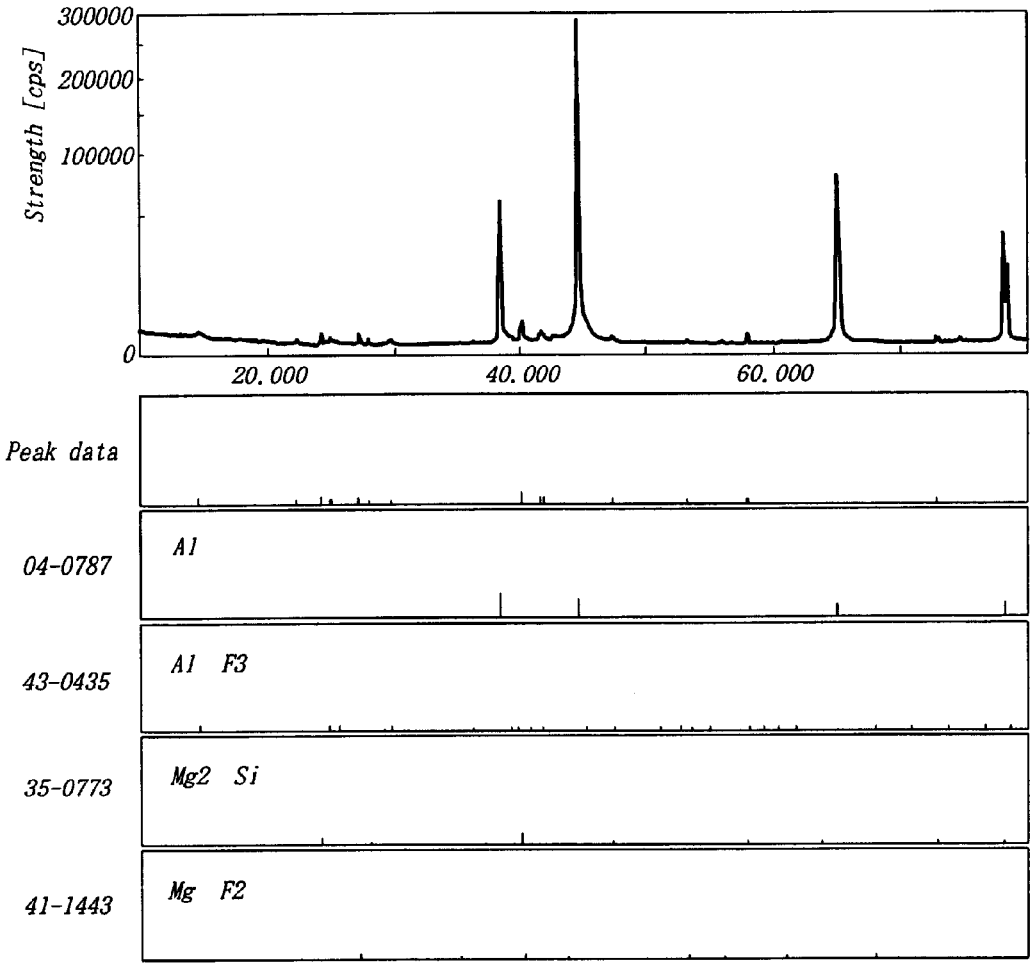
FIG. 7 is a chart illustrating a result of an X-ray diffraction on a surface region of the anti-corrosion member in the experiment 11.

FIG. 7 is a chart showing a result of the X-ray diffraction analysis on a surface region of this anti-corrosion member. As shown in FIG. 7, a crystal phase having the same structure as that of $AlF_3$ (JCPDS43-0435) and a crystal phase having the same structure as that of $MgF_2$ (JCPDS41-1443) are identified other than a peak of JIS6061 alloy constructing the base member.

Figure 8:
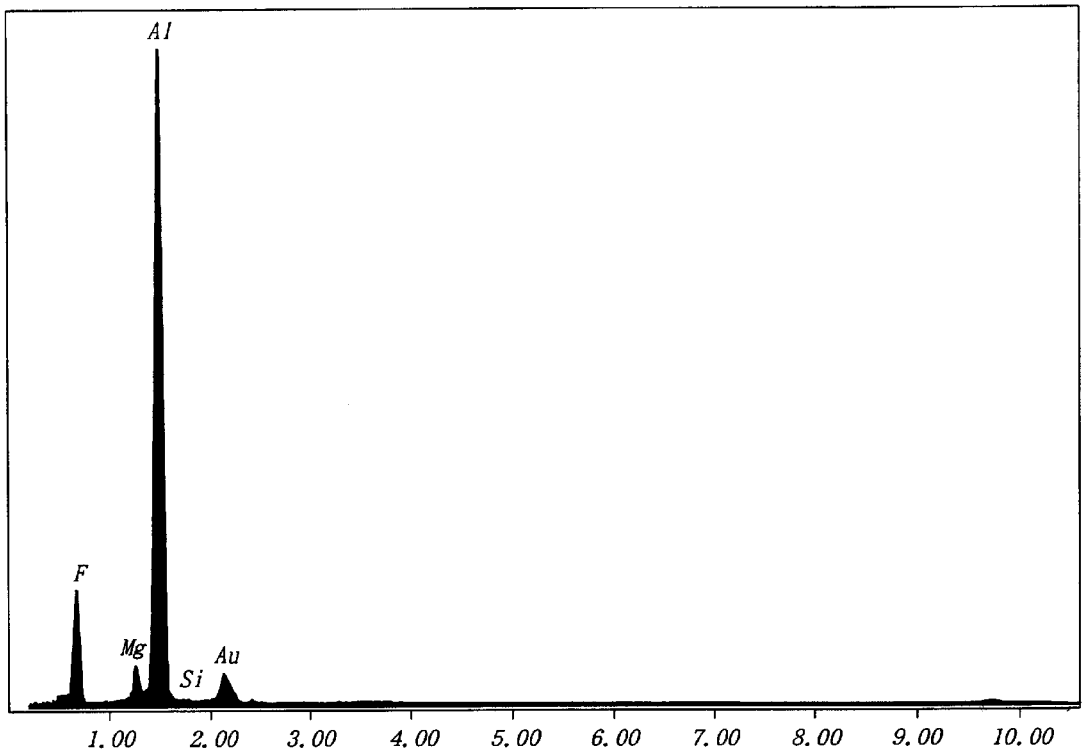
FIG. 8 is a chart depicting an analyzing result by means of EDS on the surface region of the anti-corrosion member in the experiment 11.

FIG. 8 is a chart showing a result of the EDS analysis on a surface of the anti-corrosion member. It is understood that an F element is existent on a surface of the anti-corrosion member.

With respect to the anti-corrosion member, the corrosion tests A and B mentioned above were performed. The results of the corrosion tests are shown in Table 3. In Table 3, the corrosion test A (weight increase due to fluorine plasma gas exposure) and the corrosion test B (weight loss due to chlorine plasma gas exposure) are shown.

EXAMPLE 12

The anti-corrosion member was produced in the same manner as that of example 11. However, in the process of example 11, the heat treatment was performed at 100° C. for 16 hours after the sealed fluorine resin container was set in the oven. In this case, a pressure in the container during the heat treatment was about 2 atm.

Figure 9:
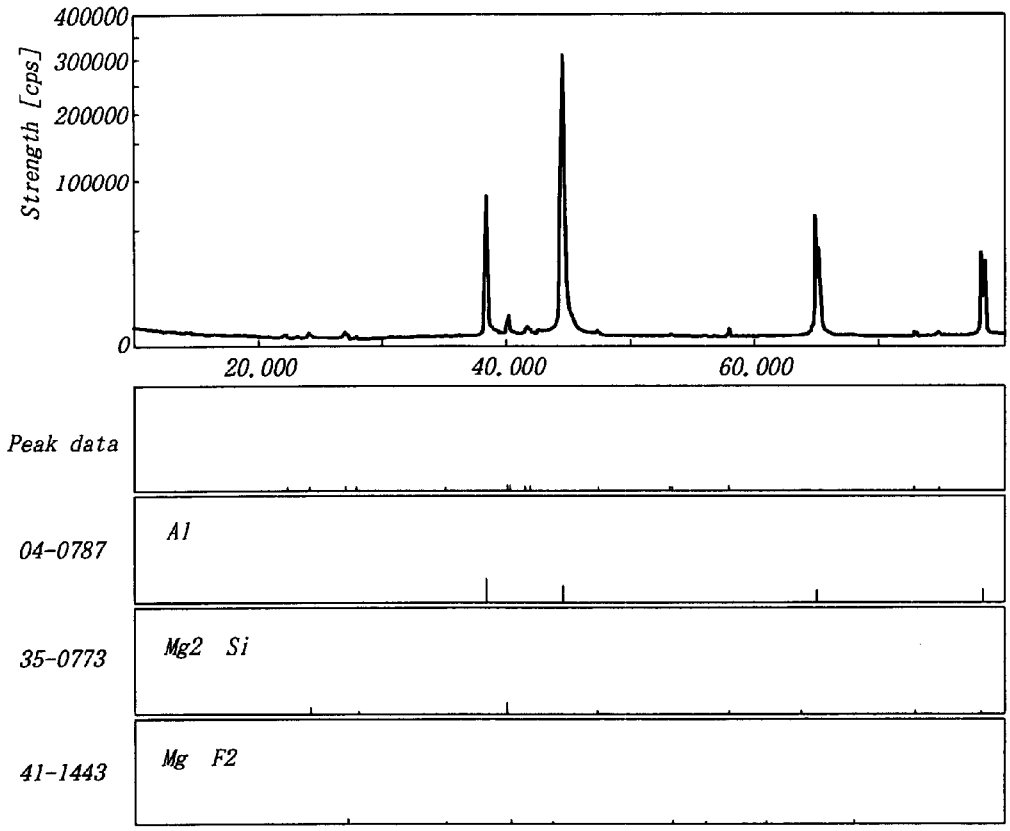
FIG. 9 is a chart showing a result of an X-ray diffraction on a surface region of an anti-corrosion member in an experiment 12.

As is the same as example 11, the anti-corrosion member was subjected to the observations by the scanning electron microscope, the X-ray diffraction analysis and the EDS analysis. FIG. 9 is a chart showing a result of the X-ray diffraction analysis. As shown in FIG. 9, a crystal phase having the same structure as that of $MgF_2$ (JCPDS41-1443) is only detected other than JIS6061 alloy constructing the base member.

From a result of the EDS analysis on a surface of the anti-corrosion member, it was confirmed that a fluorine element was existent on a surface of the anti-corrosion member. Moreover, from a result of the SEM observation, it was confirmed that a thin film formed by crystal particles having a particle size of about 0.3 $\mu$m covered a surface of the base member. The results of the corrosion tests A and B are shown in Table 3.

EXAMPLE 13

The anti-corrosion member was produced in the same manner as that of example 11. However, in the process of example 11, the aluminum alloy (JIS 1050 alloy) plate having a length of 10 mm, a breadth of 10 mm and a thickness of 2 mm was used instead of JIS6061 alloy.

Then, the aluminum alloy plate was picked up from the sealed container after the fluorizing treatment. In this case, a surface of the aluminum alloy plate was covered with a powdery precipitation member having a white color. The X-ray diffraction method confirmed that the precipitation member was a compound having the same crystal structure as that of $(NH_4)_3AlF_6$.

Then, the aluminum alloy plate was subjected to a heat treatment in an atmosphere at 500° C. for 2 hours under a condition such that a surface of the aluminum alloy plate was maintained to be covered with the precipitation member. After the heat treatment, an adhesion of aluminum fluoride ammonium remained on a surface of the aluminum alloy plate. This sample was subjected to an ultrasonic cleaning in acetone. As a result, aluminum fluoride ammonium was easily peeled off, and the aluminum alloy plate appeared from inside. A surface of the aluminum alloy plate showed a state such that a brilliance of the plate was lost. Therefore, it was thought that some thin film was formed on a surface of the aluminum alloy plate.

Figure 10:
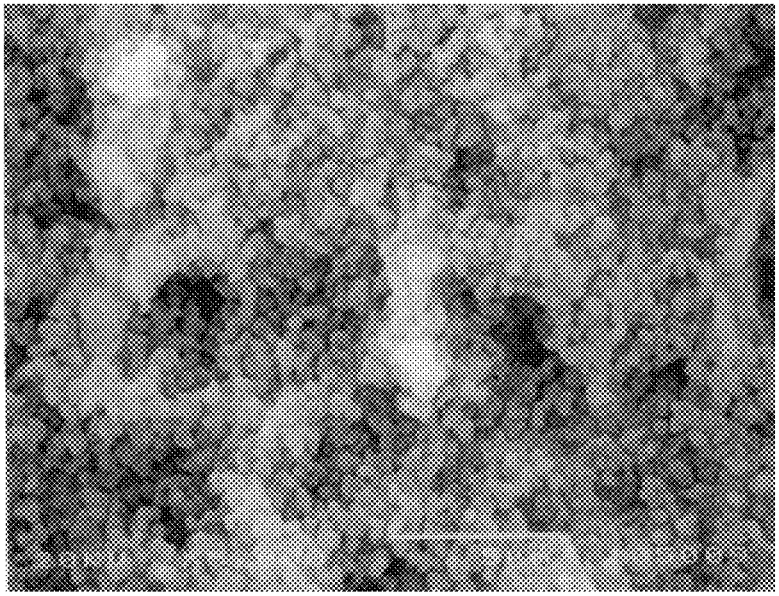
FIG. 10 is an SEM photograph of an anti-corrosion film formed on a surface of an anti-corrosion member in an experiment 13 (5000 magnification)
Figure 11:
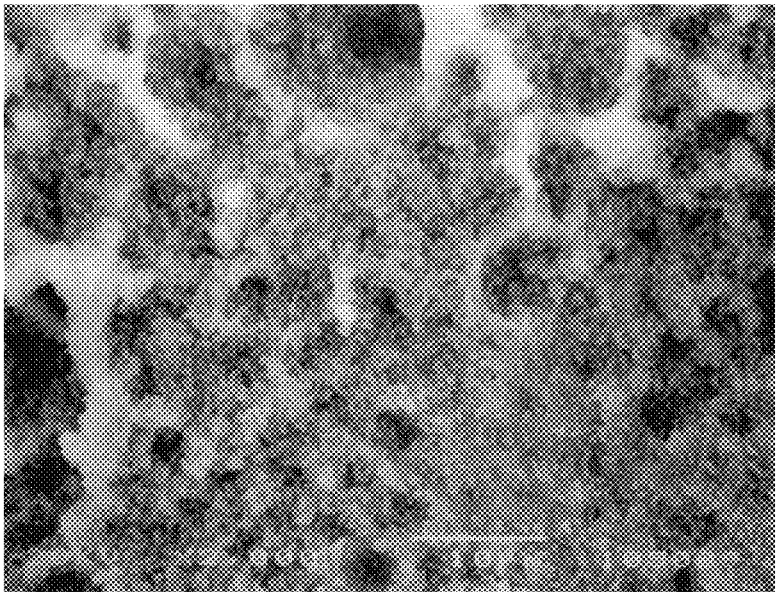
FIG. 11 is an SEM photograph of the anti-corrosion film formed on a surface of the anti-corrosion member in the experiment 13 (2000 magnification)
Figure 12:
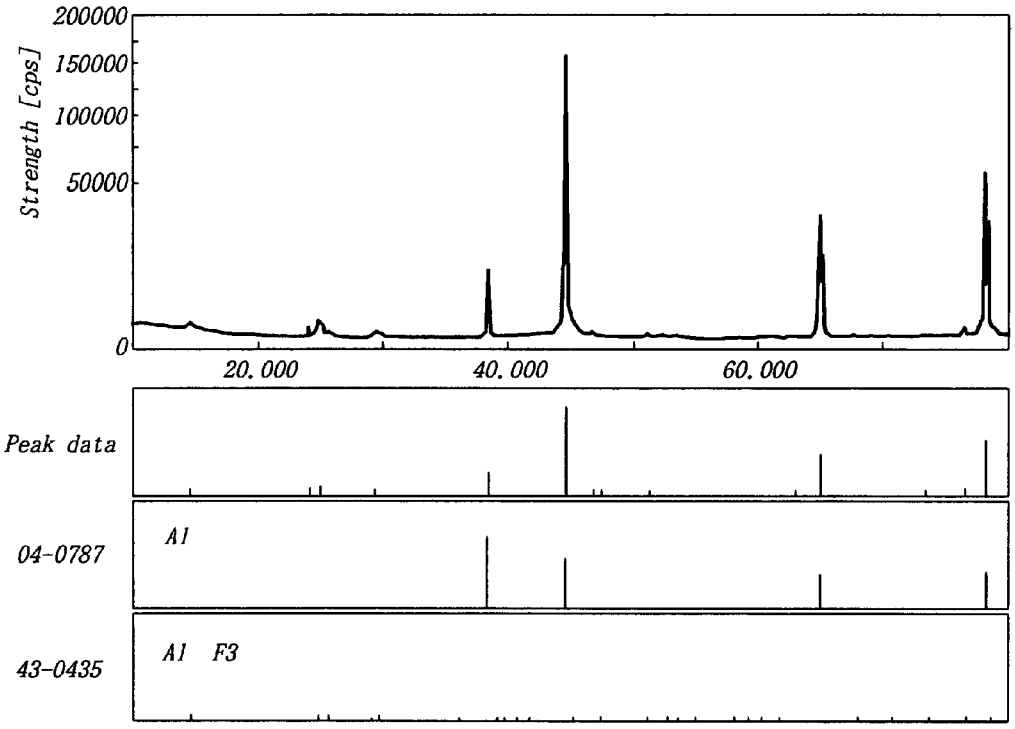
FIG. 12 is a chart illustrating a result of an X-ray diffraction on a surface of the anti-corrosion member in the experiment 13.

Photographs of a surface of the thus obtained anti-corrosion member taken by a scanning electron microscope (SEM) are shown in FIG. 10 (5000 magnification) and FIG. 12 (2000 magnification). From these photographs, it is understood that a thin film formed by crystal particles having a particle size of about 0.5 $\mu$m covers a surface of the base member. When a line was drawn on a surface of the anti-corrosion film, the number of boundary phases across the line was average 21 per the line having a length of 10 $\mu$m.

Figure 13:
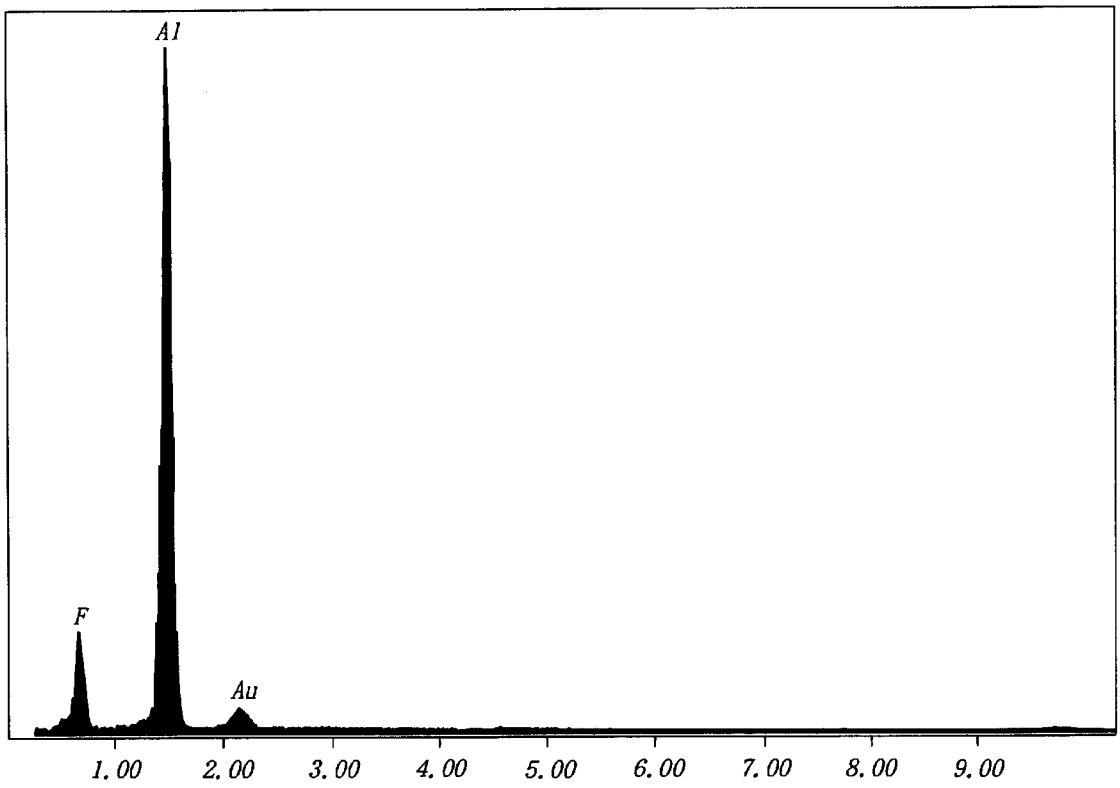
FIG. 13 is a chart depicting an analyzing result by means of EDS on the surface region of the anti-corrosion member in the experiment 13.

FIG. 12 is a chart showing a result of the X-ray diffraction analysis on a surface region of this anti-corrosion member. As shown in FIG. 12, a crystal phase having the same structure as that of $AlF_3$ (JCPDS43-0435) is only detected other than a peak of JIS1050 alloy constructing the base member. FIG. 13 is a chart showing a result of the EDS analysis on a surface of the anti-corrosion member. It is understood that an F element is formed on a surface of the anti-corrosion member. With respect to the anti-corrosion member, the corrosion tests A and B mentioned above were performed. The results of the corrosion tests are shown in Table 3.

EXAMPLE 14

$(NH_4)_3AlF_6$ powders were produced by reacting aluminum hydroxide and fluoride ammonium saturated solution. The thus produced powders were filled in an open type alumina crucible, and an aluminum alloy (JIS6061) plate having a length of 10 mm, a breadth of 10 mm and a thickness of 2 mm was embedded in the powders. Then, a heat treatment was performed in an atmosphere at 500° C. for 2 hours. The aluminum alloy plate was picked up after the heat treatment. A surface of the aluminum alloy plate had no brilliance.

Photographs of a surface of the thus obtained anti-corrosion member taken by a scanning electron microscope (SEM) at 5000 magnification and 2000 magnification were observed. The number of boundary phases across the line was an average of 9 per line having a length of 10 $\mu$m.

From a result of the X-ray diffraction analysis, a crystal phase having the same structure as that of $AlF_3$ (JCPDS43-0435) and a crystal phase having the same structure as that of $MgF_2$ (JCPDS41-1443) are detected other than JIS6061 alloy constructing the base member. From a result of the EDS analysis on a surface of the anti-corrosion member, it was confirmed that a fluorine element was existent on a surface of the anti-corrosion member. The results of the corrosion tests A and B are shown in Table 3.

EXAMPLE 15

$(NH_4)_3AlF_6$ powders were produced by reacting aluminum hydroxide and fluoride ammonium saturated solution. The thus obtained powders were scattered in ethanol to obtain a scattered solution, and a suitable amount of polyvinyl butyral was added in the scattered solution to produce a slurry. The thus produced slurry was applied by using a brush to an aluminum alloy (JIS5083) plate having a length of 10 mm, a breadth of 10 mm and a thickness of 2 mm. After ethanol was evaporated, this sample was subjected to a heat treatment under an atmosphere at 450° C. for 10 hours. The aluminum alloy plate was picked up after the heat treatment, and the thus picked up aluminum alloy plate was subjected to an ultrasonic cleaning. As a result, an adhesion substance on a surface of the aluminum alloy plate was removed. In this case, a brilliance of a surface of the aluminum alloy plate was lost.

Photographs of a surface of the thus obtained anti-corrosion member taken by a scanning electron microscope (SEM) at 5000 magnification and 2000 magnification were observed. The number of boundary phases across the line was average 11 per the line having a length of 10 $\mu$m.

From a result of the X-ray diffraction analysis, a crystal phase having the same structure as that of $AlF_3$ (JCPDS43-0435) and a crystal phase having the same structure as that of $MgF_2$ (JCPDS41-1443) are detected other than JIS6061 alloy constructing the base member. From a result of the EDS analysis on a surface of the anti-corrosion member, it was confirmed that a fluorine element was existent on a surface of the anti-corrosion member. The results of the corrosion tests A and B are shown in Table 3.

TABLE 3

| | Example 11 | Example 12 | Example 13 | Example 14 | Example 15 |
|---|---|---|---|---|---|
| Material of base member | JIS 6061 | JIS 6061 | JIS 1050 | JIS 6061 | JIS 5083 |
| Kind of fluorine compound | $NH_4HF_2$ | $NH_4HF_2$ | $NH_4HF_2$ | — | — |
| Temperature of fluoridized treatment (° C.) | 250 | 100 | 250 | — | — |
| Time internal of fluoridized treatment (hour) | 16 | 16 | 16 | — | — |
| Inner pressure of sealed container (atm) | 12 | 2 | 12 | — | — |
| Temperature of heat treatment under atmosphere (° C.) | 500 | 500 | 500 | 500 | 450 |
| Time internal of heat treatment under atmosphere (hour) | 2 | 2 | 2 | 2 | 10 |
| Generation phase other than aluminum alloy | $AlF_3$ $MgF_2$ | $MgF_2$ | $AlF_3$ | $AlF_3$ $MgF_2$ | $AlF_3$ $MgF_2$ |
| Number of boundary phases of fluoride film | 10 | 32 | 21 | 9 | 11 |
| Anti-corrosion test A: weight increase due to fluorine plasma gas exposure (mg/cm$^2$) | <0.1 | <0.1 | 0.3 | <0.1 | 0.1 |
| Anti-corrosion test B: weight loss due to chlorine plasma gas exposure (mg/cm$^2$) | <0.1 | 0.3 | 0.8 | <0.1 | 0.2 |

As mentioned above, according to the invention, it is possible to obtain the anti-corrosion member which shows a high corrosion property with respect to the corrosion gas of halogen series and its plasma, particularly with respect to the chlorine gas and its plasma.

What is claimed is:

1. An anti-corrosion member comprising a single-layered base member comprising one of an aluminum-containing metal, an aluminum-containing ceramic, or a composite member including an aluminum-containing metal and a ceramic, and an anti-corrosion film made of a fluoride formed directly on a surface of the base member by setting the base member in a container in which a solid fluorine compound is filled and by heating the container at a temperature higher than a decomposition temperature of the solid fluorine compound.

2. The anti-corrosion member according to claim 1, wherein the fluorine compound is selected from $NaHF_2$, $KHF_2$ and $NH_4HF_2$.

3. The anti-corrosion member according to claim 1, wherein the anti-corrosion film comprises a crystal phase of aluminum fluoride.

4. The anti-corrosion member according to claim 1, wherein the anti-corrosion film comprises a crystal phase of magnesium fluoride.

5. An anti-corrosion member in which an anti-corrosion film made of a fluoride is formed directly on a surface of a single-layered base member comprising one of an aluminum-containing metal, an aluminum-containing ceramic, or a composite member including an aluminum-containing metal and a ceramic, wherein a weight loss of the anti-corrosion member, when the anti-corrosion member is exposed at 460° C. for 5 hours in a chlorine plasma gas obtained by excitation at a high frequency of 13.56 MHz and 800 W, is smaller than 15 mg/cm$^2$.

6. An anti-corrosion member having a single-layered base member comprising one of an aluminum-containing metal, an aluminum-containing ceramic, or a composite member including an aluminum-containing metal and a ceramic, and an anti-corrosion film made of a fluoride formed directly on a surface of the base member by setting the base member in a container in which a solid fluorine compound is filled and by heating the container at a temperature higher than a decomposition temperature of the solid fluorine compound, wherein a weight loss of the anti-corrosion member, when the anti-corrosion member is exposed at 460° C. for 5 hours in a chlorine plasma gas obtained by excitation at a high frequency of 13.56 MHz and 800 W, is smaller than 15 mg/cm$^2$.

7. An anti-corrosion member having a base member made of a metal in which aluminum is included and an anti-corrosion film made of a fluoride formed directly on a surface of the base member, comprising a structure such that:

(1) the anti-corrosion film is made of particles of the fluoride which covers a surface of the base member;

(2) when a line of 10 $\mu$m in length is drawn on a surface of the anti-corrosion film, the number of boundary phases across the line is smaller than 100 and larger than 5; and (3) the particles include at least one of aluminum fluoride phase and magnesium fluoride phase.

8. The anti-corrosion member according to claim 7, wherein the particles include at least the aluminum fluoride phase and the magnesium fluoride phase.

9. The anti-corrosion member according to claim 7, wherein the anti-corrosion film is generated by reacting the base member with aluminum fluoride ammonia.

10. The anti-corrosion member according to claim 9, wherein the aluminum in said aluminum fluoride ammonia is substituted at least partially by another metal.

* * * * *